US008525580B2

(12) United States Patent
Morino et al.

(10) Patent No.: US 8,525,580 B2
(45) Date of Patent: Sep. 3, 2013

(54) SEMICONDUCTOR CIRCUIT AND CONSTANT VOLTAGE REGULATOR EMPLOYING SAME

(75) Inventors: Koichi Morino, Kanagawa (JP); Yuki Kashima, Kanagawa (JP); Masatoshi Ito, Kanagawa (JP); Shimpei Sakai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 42 days.

(21) Appl. No.: 13/173,024

(22) Filed: Jun. 30, 2011

(65) Prior Publication Data

US 2012/0013396 A1 Jan. 19, 2012

(30) Foreign Application Priority Data

Jul. 15, 2010 (JP) ..... 2010-160572

(51) Int. Cl.
*G05F 1/10* (2006.01)

(52) U.S. Cl.
USPC ..... 327/540

(58) Field of Classification Search
None
See application file for complete search history.

(56) References Cited

U.S. PATENT DOCUMENTS

| | | | | |
|---|---|---|---|---|
| 3,369,129 | A * | 2/1968 | Wolterman | 327/328 |
| 4,727,309 | A * | 2/1988 | Vajdic et al. | 323/315 |
| 4,918,336 | A * | 4/1990 | Graham et al. | 326/117 |
| 5,008,565 | A * | 4/1991 | Taylor | 327/543 |
| 5,239,208 | A * | 8/1993 | Tezuka | 327/427 |
| 5,291,121 | A * | 3/1994 | Neale et al. | 323/313 |
| 5,519,313 | A * | 5/1996 | Wong et al. | 323/315 |
| 6,163,140 | A * | 12/2000 | Garnett et al. | 323/234 |
| 6,441,593 | B1 * | 8/2002 | Saripella | 323/268 |
| 7,394,307 | B2 | 7/2008 | Negoro et al. | |
| 7,474,145 | B2 * | 1/2009 | Negoro | 327/543 |
| 7,535,286 | B2 * | 5/2009 | Shimada | 327/543 |
| 7,728,566 | B2 | 6/2010 | Negoro et al. | |
| 7,782,124 | B2 * | 8/2010 | Bando | 327/544 |
| 7,944,663 | B2 | 5/2011 | Morino | |
| 7,965,475 | B2 | 6/2011 | Morino | |
| 2005/0275375 | A1 * | 12/2005 | Liu et al. | 320/128 |
| 2006/0152284 | A1 | 7/2006 | Morino | |
| 2007/0182398 | A1 * | 8/2007 | Hahn | 323/285 |
| 2009/0046404 | A1 | 2/2009 | Morino | |
| 2009/0195227 | A1 | 8/2009 | Morino | |
| 2010/0053831 | A1 * | 3/2010 | Sosa-Dias et al. | 361/91.5 |
| 2010/0244885 | A1 * | 9/2010 | Lee et al. | 324/771 |
| 2011/0080761 | A1 * | 4/2011 | Kung | 363/127 |

FOREIGN PATENT DOCUMENTS

| | | |
|---|---|---|
| JP | 2706721 | 10/1997 |
| JP | 2003-67063 | 3/2003 |
| JP | 2007-19861 | 8/2007 |
| JP | 2007-251503 | 9/2007 |
| JP | 2007-310521 | 11/2007 |
| JP | 2008-282118 | 11/2008 |
| JP | 2008-287307 | 11/2008 |

(Continued)

*Primary Examiner* — Thomas J Hiltunen
(74) *Attorney, Agent, or Firm* — Cooper & Dunham LLP

(57) ABSTRACT

A semiconductor circuit includes a voltage regulator and a buffer transistor. The voltage regulator converts an input voltage input to an input terminal thereof into an output voltage output to an output terminal thereof. The buffer transistor is an n-channel depletion-mode metal-oxide semiconductor field effect transistor, disposed between the power supply terminal and the voltage regulator with a gate terminal thereof connected to the power supply terminal, a drain terminal thereof connected to the power supply terminal, and a source terminal thereof connected to the input terminal of the voltage regulator.

15 Claims, 7 Drawing Sheets

(56) References Cited

FOREIGN PATENT DOCUMENTS

| | | |
|---|---|---|
| JP | 4061988 | 11/2008 |
| JP | 2008-310616 | 12/2008 |
| JP | 2009-48362 | 3/2009 |
| JP | 2009-211667 | 9/2009 |
| JP | 4393152 | 10/2009 |
| JP | 4458457 | 2/2010 |
| JP | 4582705 | 9/2010 |
| JP | 4587804 | 9/2010 |

* cited by examiner

SEMICONDUCTOR CIRCUIT AND CONSTANT VOLTAGE REGULATOR EMPLOYING SAME

BACKGROUND OF THE INVENTION

1. Technical Field

The present invention relates to a semiconductor circuit and a constant voltage regulator employing the same, and more particularly, to a semiconductor circuit for use in constant voltage regulation which can prevent variations in output voltage due to abrupt changes in input voltage, and a constant voltage regulator employing such a semiconductor circuit.

2. Description of the Background Art

Voltage regulators are employed in power supply circuitry which generates a regulated voltage from an input voltage to drive a load circuit that operates with constant power. In electronic applications, a voltage regulator is implemented in a single integrated circuit (IC), typically together with load circuitry, such as a microcontroller or other electronic components, to which electrical power is supplied from an external power source such as battery.

FIG. 1 is a circuit diagram schematically illustrating a configuration of a known voltage regulator 101.

As shown in FIG. 1, the voltage regulator 101 comprises a series regulator that converts an input voltage V111 supplied from a power supply terminal 111 to a regulated, constant output voltage V113 for output to an output terminal 113, consisting of a driver transistor M112, being a p-channel metal-oxide semiconductor (PMOS) device, having a source terminal thereof connected to the power supply terminal 111 and a drain terminal thereof connected to the output terminal 113; a pair of voltage divider resistors R111 and R112 connected in series between the output terminal 113 and a ground terminal 112 to form a feedback node therebetween; a reference voltage generator 116 connected between the input terminal 114 and the ground terminal 112; and a differential amplifier 115 having a non-inverting input thereof connected to the voltage divider node, an inverting input thereof connected to the reference voltage generator 116, and an output thereof connected to a gate terminal of the driver transistor M112, with a pair of power supply inputs thereof connected between the input terminal 114 and the ground terminal 112.

Components of the voltage regulator 101 may be integrated into a single IC, with the input voltage V111 being input from an external power source connected to the power supply terminal 111, and the output voltage V113 output to a load circuit connected to the output terminal 113.

During operation, the driver transistor M112 conducts an electric current therethrough according to a voltage applied to the gate terminal, so as to output a regulated output voltage V113 to the output terminal 113. The voltage divider resistors R111 and R112 generate a feedback voltage Vfb proportional to the output voltage V113 at the feedback node therebetween, whereas the reference voltage generator 116 generates a reference voltage Vref for comparison with the feedback voltage Vfb. The differential amplifier 115, receiving the feedback voltage Vfb at the non-inverting input and the reference voltage Vref at the inverting input, controls operation of the driver transistor M112 according to a result of comparison between the differential inputs Vfb and Vref, thereby regulating the output voltage V113 to a desired constant level.

FIGS. 2A and 2B are graphs showing the voltages V111 and V113 in volts (V) plotted against time in microseconds (μs), obtained at the power supply terminal 111 and the output terminal 113, respectively, during operation of the voltage regulator 101.

As shown in FIGS. 2A and 2B, the output voltage V113 of the voltage regulator 101, which is normally regulated to a constant level of approximately 3.3 V, experiences a sharp, transient change as the power supply voltage V111 suddenly changes in amplitude. Specifically, the output voltage V113 "overshoots" (i.e., rises sharply and transiently above the constant level) at time t0 where the power supply voltage V111 suddenly increases from 5 V to 25 V, and then "undershoots" (i.e., falls sharply and transiently below the constant level) at time t1 where the power supply voltage V111 suddenly decreases from 25 V to 5 V.

One problem encountered by the voltage regulator 101 depicted above is that those sharp transient changes of the output voltage V113, if significant, can adversely affect proper operation of the load circuit powered through the regulator circuitry. In practice, a large voltage overshoot of e.g., 1.0 V may damage the load circuit where the voltage V113 exceeds its rated maximum voltage, whereas a large voltage undershoot of e.g., 1.0 V may cause the load circuit to fail or malfunction where the voltage V113 exceeds its minimum operating voltage.

To counteract the problem, various methods have been proposed to provide a voltage regulation circuitry whose output voltage is stabilized against variations in input power supply voltage.

For example, one conventional method provides a voltage regulator formed of a differential amplifier circuit that outputs an output voltage to an output terminal connected with a transistor switch. According to this method, the voltage regulator is equipped with a voltage comparator that monitors the output voltage to control a gate voltage of the transistor switch according to a result of comparison between the output voltage and a reference voltage. Upon detecting a voltage overshoot due to a sudden change in input voltage, the voltage comparator causes the transistor switch to discharge capacitance, thereby stabilizing the output voltage.

One drawback of this method is that using the voltage monitor is costly since it includes a comparator adding to cost and power consumption in the voltage regulator. The method also has a drawback in that the feedback control based on the voltage comparator requires a certain period of time until the output voltage is adjusted in response to the feedback signal received, making the system less effective or practical than would be desired for its intended purpose.

Another conventional method provides a voltage regulator using an output transistor that regulates an output voltage according to a control signal output from an error amplifier comparing the output voltage against a reference voltage. According to this method, the voltage regulator is equipped with a voltage monitor consisting of a constant current circuit and a capacitor, which monitors a power supply voltage input to the voltage regulator and temporarily increases power supplied to the error amplifier upon detecting a sudden change in the power supply voltage. Increasing power input to the error amplifier enables the error amplifier to operate with a high slew rate, resulting in the control circuit exhibiting good response to the changing power supply voltage.

This method has a drawback in that, for proper functioning of the capacitor-based voltage monitor, the voltage regulator involves a capacitor of several picofarads, which is large in size and thus costly to implement on an IC-packaged device. Moreover, the method is not suitable for battery-powered applications, since supplying a large supply voltage to the error amplifier, if temporary, can reduce lifetime of the battery supplying power to the voltage regulator.

BRIEF SUMMARY

This disclosure describes an improved semiconductor circuit for use in connection with a power supply terminal.

In one aspect of the disclosure, the improved semiconductor circuit includes a voltage regulator and a buffer transistor. The voltage regulator converts an input voltage input to an input terminal thereof into an output voltage output to an output terminal thereof. The buffer transistor is an n-channel depletion-mode metal-oxide semiconductor field effect transistor, disposed between the power supply terminal and the voltage regulator with a gate terminal thereof connected to the power supply terminal, a drain terminal thereof connected to the power supply terminal, and a source terminal thereof connected to the input terminal of the voltage regulator.

This disclosure also describes an improved voltage regulator for use in connection with a power supply terminal.

In one aspect of the disclosure, the improved voltage regulator includes an input terminal, an output terminal, a driver transistor, and a buffer transistor. The input terminal receives an input voltage supplied from the power supply terminal. The output terminal outputs an output voltage to load circuitry. The driver transistor is connected between the input and output terminals to convert the input voltage into the output voltage. The buffer transistor is an n-channel depletion-mode metal-oxide semiconductor field effect transistor, disposed between the power supply terminal and the voltage regulator with a gate terminal thereof connected to the power supply terminal, a drain terminal thereof connected to the power supply terminal, and a source terminal thereof connected to the input terminal of the voltage regulator.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
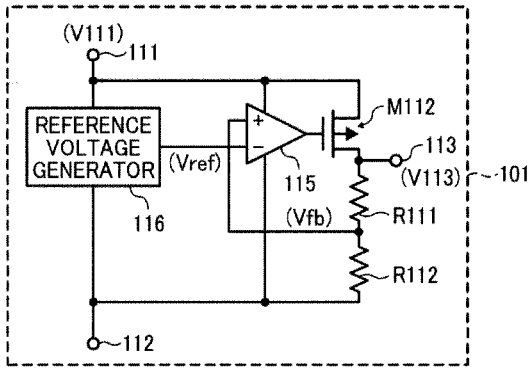
FIG. 1 BACKGROUND ART
FIG. 1 is a circuit diagram schematically illustrating a configuration of a known voltage regulator.
Figure 2A:
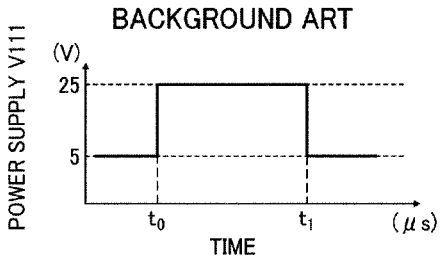
FIG. 2A BACKGROUND ART
FIGS. 2A and 2B are graphs showing voltages in volts (V) plotted against time in microseconds (μs), obtained at a power supply terminal and an output terminal, respectively, during operation of the voltage regulator of FIG. 1.
Figure 2B:
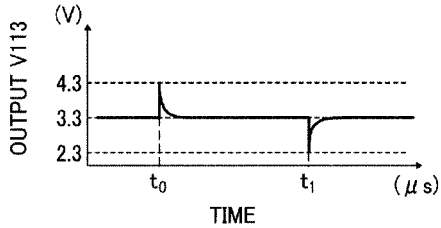
FIG. 2B BACKGROUND ART

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, examples and exemplary embodiments of this disclosure are described.

Figure 3:
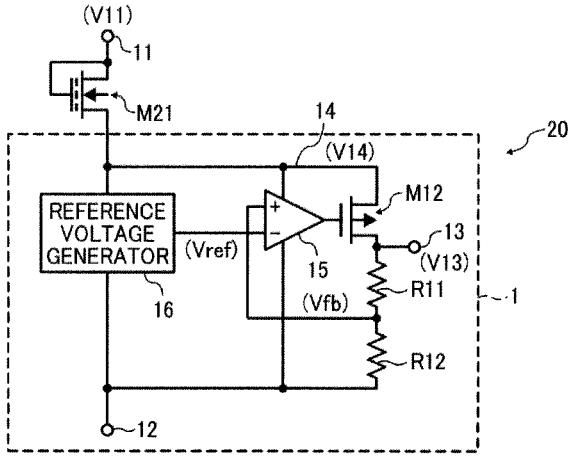
FIG. 3 is a circuit diagram schematically illustrating a semiconductor circuit according to a first embodiment of this patent specification.

FIG. 3 is a circuit diagram schematically illustrating a semiconductor circuit 20 according to a first embodiment of this patent specification.

As shown in FIG. 3, the semiconductor circuit 20 includes a constant voltage regulator 1 that converts an input voltage V11 supplied to an input terminal 14 from a power supply terminal 11 to a regulated, constant output voltage V13 for output to an output terminal 13, as well as a buffer transistor M21, being a depletion-mode n-channel metal-oxide semiconductor (NMOS) field effect transistor, having a gate terminal thereof connected to the power supply terminal 11, a drain terminal connected to the power supply terminal 11, and a source terminal thereof connected to the input terminal 14.

The constant voltage regulator 1 includes a driver transistor M12, being a p-channel metal-oxide semiconductor (PMOS) device, having a source terminal thereof connected to the input terminal 14 and a drain terminal thereof connected to the output terminal 13; a pair of voltage divider resistors R11 and R12 connected in series between the output terminal 13 and a ground terminal 12 to form a feedback node therebetween; a reference voltage generator 16 connected between the input terminal 14 and the ground terminal 12; and a differential amplifier 15 having a non-inverting input thereof connected to the voltage divider node, an inverting input thereof connected to the reference voltage generator 16, and an output thereof connected to a gate terminal of the driver transistor M12, with a pair of power supply inputs connected between the input terminal 14 and the ground terminal 12.

Components of the semiconductor circuit 20 depicted above may be integrated into a single integrated circuit (IC), in which case the supply terminal 11 is configured as a power supply terminal of the IC supplied with an external power source, not shown.

During operation, the constant voltage regulator 1 performs voltage regulation with the driver transistor M12 conducting an electric current therethrough according to a voltage applied to the gate terminal, so as to output an output voltage V13 to the output terminal 113. The voltage divider resistors R11 and R12 generate a feedback voltage Vfb proportional to the output voltage V13 at the feedback node therebetween, whereas the reference voltage generator 16 generates a reference voltage Vref for comparison with the feedback voltage Vfb. The differential amplifier 15, receiving the feedback voltage Vfb at the non-inverting input and the reference voltage Vref at the inverting input, controls operation of the driver transistor M12 according to a result of comparison between the differential inputs Vfb and Vref, thereby regulating the output voltage V13 to a desired constant level.

The depletion-mode buffer transistor M21 conducts current as long as the voltage V11 at the power supply terminal 11 remains positive, so that the voltage V14 at the input terminal 14 remains substantially equal to or slightly lower than the power supply voltage V11. In this state, the voltage regulator 1 can properly regulate the output voltage V13 at a constant level, which in the present example is approximately 3.3 V.

Figure 4A:
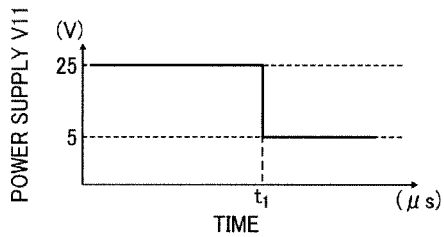
FIGS. 4A through 4C are graphs showing voltages in volts (V) plotted against time in microseconds (μs), obtained at a power supply terminal, an input terminal, and an output terminal, respectively, during operation of the semiconductor circuit of FIG. 3.
Figure 4B:
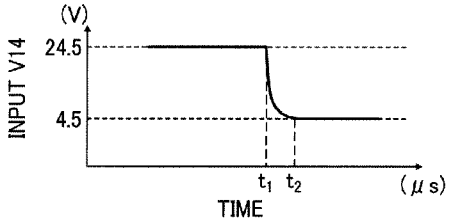
Figure 4C:
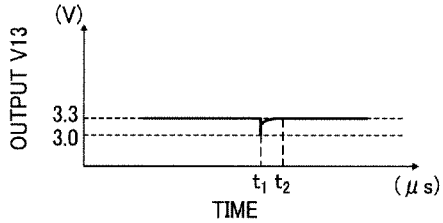

FIGS. 4A through 4C are graphs showing the voltages V11, V14, and V13 in volts (V) plotted against time in microseconds (μs), obtained at the power supply terminal 11, the input terminal 14, and the output terminal 13, respectively, during operation of the semiconductor circuit 20.

As shown in FIGS. 4A through 4C, as the power supply voltage V11 suddenly decreases from 25 V to 5 V at time t1, the input voltage V14 of the voltage regulator 1 in turn decreases from 24.5 V to 4.5 V, causing the output voltage V13 to transiently decrease from 3.3 V to 3.0 V.

Note that the input voltage V14, whose amplitude is generally consistent with that of the power supply voltage V11, does not experience an abrupt, steep transition as that experienced by the power supply voltage V11 at time t1. Instead, the input voltage V14 gradually decreases over a period of time (for example, approximately 10 μs in the present embodiment) between time t1 and time t2. The transition of the input voltage, thus buffered or slowed down, results in an reduced amount of "undershoot" exhibited by the output voltage V13 falling below the constant level of 3.3 V, which is significantly smaller than that would otherwise be obtained.

Such undershoot suppression capability of the semiconductor circuit 20 upon a sudden decrease in the power supply voltage V11 is derived from provision of the depletion-mode MOSFET M21 between the power supply terminal 11 and the input terminal 14, which serves as a constant current circuit conducting a drain current id from the input terminal 14 to the power supply terminal 11 where the input voltage V14 becomes higher than the power supply voltage V11.

Figure 5A:
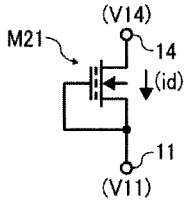
FIG. 5A is a circuit diagram showing a buffer transistor with its drain current flowing from the input terminal to the power supply terminal, included in the semiconductor circuit of FIG. 3.

Specifically, with additional reference to FIG. 5A, the buffer transistor M21 is shown with its drain current id flowing from the input terminal 14 to the power supply terminal 11 where the input voltage V14 exceeds the power supply voltage V11, causing a potential difference V14-V11 applied between the drain and source terminals of the transistor M21.

Figure 5B:
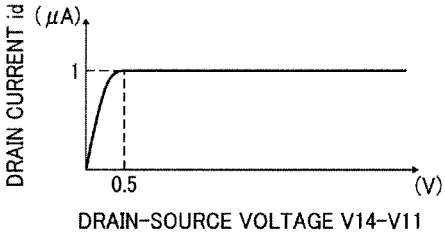
FIG. 5B is a graph showing current-voltage characteristics of the buffer transistor conducting the drain current from the input terminal to the power supply terminal, included in the semiconductor circuit of FIG. 3.

FIG. 5B is a graph showing current-voltage characteristics of the transistor M21 conducting the drain current id from the input terminal V14 to the power supply terminal V11. As shown in FIG. 5B, the drain current id remains substantially constant at approximately 1 microampere (μA) where the drain-source voltage V14-V11 is sufficiently large, that is, above approximately 0.5 V in the present embodiment.

Thus, as the power supply voltage V11 suddenly falls below the input voltage V14, the buffer transistor M21 serves as a constant current circuit through which any electric charges present at the input terminal 14, such as those stored in the parasitic capacitance, are discharged to the power supply terminal 11 from the input terminal 14. Discharging capacitance through the transistor M21 effectively prevents an abrupt transition of the input voltage V14 due to a sudden decrease in the power supply voltage V11, resulting in a small amount of undershoot exhibited by the output voltage V13. Further buffering or slowing down of the input voltage V14 may be accomplished by providing a capacitor between the input terminal 14 and the ground terminal 12.

Figure 6:
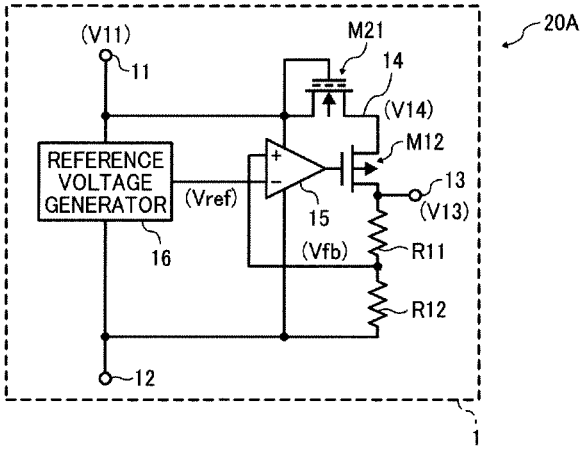
FIG. 6 is a circuit diagram schematically illustrating a semiconductor circuit according to a second embodiment of this patent specification.

FIG. 6 is a circuit diagram schematically illustrating a semiconductor circuit 20A according to a second embodiment of this patent specification.

As shown in FIG. 6, the overall configuration of the second embodiment is similar to that depicted in FIG. 3, except that the input terminal 14, that is, the source terminal of the buffer transistor M21 is connected solely to the driver transistor M12, instead of being connected in common with the driver transistor M12, the reference voltage generator 16, and the differential amplifier 15.

In such a configuration, the semiconductor circuit 20A operates in a manner similar to that depicted primarily with reference to FIG. 3, wherein the depletion-mode transistor M21 provided between the power supply terminal 11 and the input terminal 14 serves as a constant current circuit conducting a drain current from the input terminal 14 to the power supply terminal 11 to discharge capacitance at the node 14 where the power supply voltage V11 suddenly falls below the input voltage V14, so as to prevent an abrupt transition of the input voltage V14 due to a sudden decrease in the power supply voltage V11, resulting in a small amount of undershoot exhibited by the output voltage V13.

In the second embodiment, the buffer transistor M12 exerts a buffering effect solely on the drain voltage of the driver transistor M12, compared to the first embodiment which can buffer or slow down the transition not only in the input voltage of the driver transistor M12 but also in the reference voltage generator 16 and the differential amplifier 15. Such arrangement saves power consumed in the voltage regulator 1, which is particularly suitable for applications where the semiconductor circuit is operated at relatively low input voltages.

Figure 7:
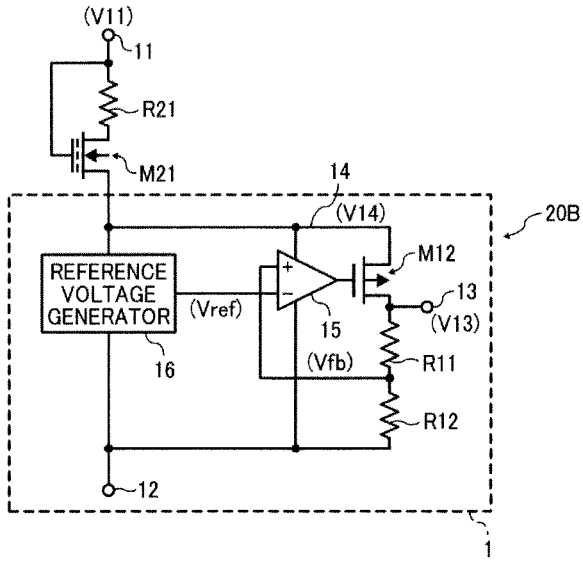
FIG. 7 is a circuit diagram schematically illustrating a semiconductor circuit according to a third embodiment of this patent specification.

FIG. 7 is a circuit diagram schematically illustrating a semiconductor circuit 20B according to a third embodiment of this patent specification.

As shown in FIG. 7, the overall configuration of the third embodiment is similar to that depicted in FIG. 3, except that the circuit 20B further includes a resistor R21 disposed between the power supply terminal 11 and the drain terminal of the buffer transistor M21.

In such a configuration, the semiconductor circuit 20A operates in a manner similar to that depicted primarily with reference to FIG. 3, wherein the depletion-mode transistor M21 provided between the power supply terminal 11 and the input terminal 14 serves as a constant current circuit conducting a drain current from the input terminal 14 to the power supply terminal 11 to discharge capacitance at the node 14 where the power supply voltage V11 suddenly falls below the input voltage V14, so as to prevent an abrupt transition of the input voltage V14 due to a sudden decrease in the power supply voltage V11, resulting in a small amount of undershoot exhibited by the output voltage V13.

Figure 8A:
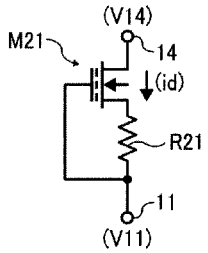
FIG. 8A is a circuit diagram showing a buffer transistor with its drain current flowing from the input terminal to the power supply terminal, included in the semiconductor circuit of FIG. 7.

Specifically, with additional reference to FIG. 8A, the buffer transistor M21 is shown with its drain current id flowing from the input terminal 14 to the power supply terminal 11 where the input voltage V14 exceeds the power supply voltage V11, causing a potential difference V14-V11 applied between the drain and source terminals of the transistor M21.

Figure 8B:
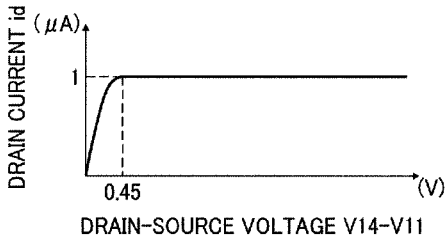
FIG. 8B is a graph showing current-voltage characteristics of the buffer transistor conducting the drain current from the input terminal to the power supply terminal, included in the semiconductor circuit of FIG. 7.

FIG. 8B is a graph showing current-voltage characteristics of the transistor M21 conducting the drain current id from the input terminal V14 to the power supply terminal V11. As shown in FIG. 8B, the drain current id remains substantially constant at approximately 1 μA where the drain-source voltage V14-V11 is sufficiently large, that is, above approximately 0.45 V in the present embodiment.

Thus, as the power supply voltage V11 suddenly falls below the input voltage V14, the buffer transistor M21 serves as a constant current circuit through which any electric charges present at the input terminal 14, such as those stored in the parasitic capacitance, are discharged to the power supply terminal 11 from the input terminal 14. Discharging capacitance through the transistor M21 effectively prevents an abrupt transition of the input voltage V14 due to a sudden decrease in the power supply voltage V11, resulting in a small amount of undershoot of the output voltage V13.

Further, in the third embodiment, addition of the resistor R21 between the power supply terminal 11 and the drain terminal of the buffer transistor M21 establishes a negative feedback in the buffer circuitry, wherein the current flow id induces a corresponding voltage across the resistor R21, which in turn increases a threshold voltage of the transistor M21, resulting in a limited amount of current id through the transistor M21. Such arrangement allows the semiconductor circuit 20B to more effectively prevent an abrupt transition in the input voltage V14 due to a sudden decrease in the power supply voltage V11, compared to the first embodiment depicted in FIG. 3.

Figure 9:
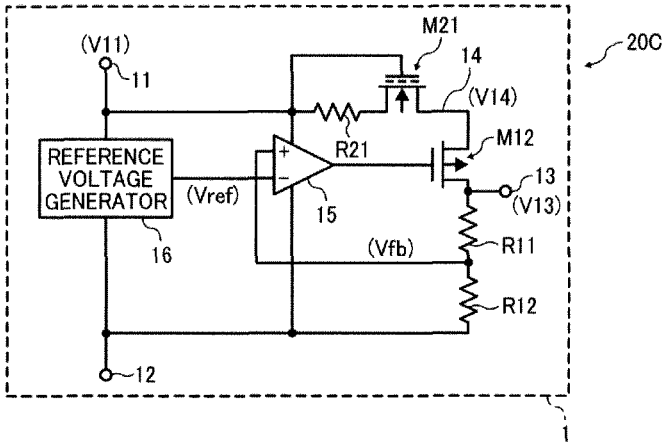
FIG. 9 is a circuit diagram schematically illustrating a semiconductor circuit 20 according to a fourth embodiment of this patent specification.

FIG. 9 is a circuit diagram schematically illustrating a semiconductor circuit 20C according to a fourth embodiment of this patent specification.

As shown in FIG. 9, the overall configuration of the fourth embodiment is similar to that depicted in FIG. 6, except that the circuit 20C further includes a resistor R21 disposed between the power supply terminal 11 and the drain terminal of the buffer transistor M21.

In such a configuration, the semiconductor circuit 20C operates in a manner similar to that depicted primarily with reference to FIG. 6, wherein the depletion-mode transistor M21 provided between the power supply terminal 11 and the input terminal 14 serves as a constant current circuit conducting a drain current from the input terminal 14 to the power supply terminal 11 to discharge capacitance at the node 14 where the power supply voltage V11 suddenly falls below the input voltage V14, so as to prevent an abrupt transition of the input voltage V14 due to a sudden decrease in the power supply voltage V11, resulting in a small amount of undershoot exhibited by the output voltage V13.

As is the case with the third embodiment, in the fourth embodiment, addition of the resistor R21 between the power supply terminal 11 and the drain terminal of the buffer transistor M21 establishes a negative feedback in the buffer circuitry, wherein the current flow id induces a corresponding voltage across the resistor R21, which in turn increases a threshold voltage of the transistor M21, resulting in a limited amount of current id through the transistor M21. Such arrangement allows the semiconductor circuit 20C to more effectively prevent an abrupt transition in the input voltage V14 due to a sudden decrease in the power supply voltage V11, compared to the second embodiment depicted in FIG. 6.

Figure 10:
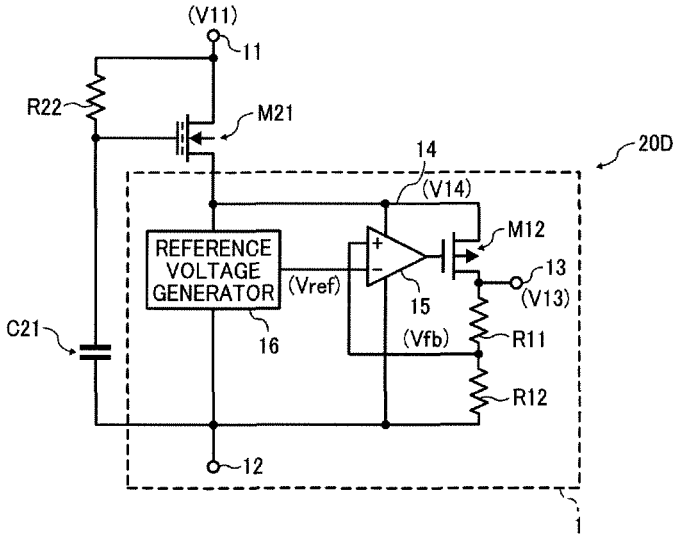
FIG. 10 is a circuit diagram schematically illustrating a semiconductor circuit according to a fifth embodiment of this patent specification.

FIG. 10 is a circuit diagram schematically illustrating a semiconductor circuit 20D according to a fifth embodiment of this patent specification.

As shown in FIG. 9, the overall configuration of the fifth embodiment is similar to that depicted in FIG. 3, except that the circuit 20D further includes a resistor R22 disposed between the power supply terminal 11 and the gate terminal of the buffer transistor M21, and a capacitor C21 disposed between the ground and the gate terminal of the buffer transistor M21.

In such a configuration, the semiconductor circuit 20D operates in a manner similar to that depicted primarily with reference to FIG. 3, wherein the depletion-mode transistor M21 provided between the power supply terminal 11 and the input terminal 14 serves as a constant current circuit conducting a drain current from the input terminal 14 to the power supply terminal 11 to discharge capacitance at the node 14 where the power supply voltage V11 suddenly falls below the input voltage V14, so as to prevent an abrupt transition of the input voltage V14 due to a sudden decrease in the power supply voltage V11, resulting in a small amount of undershoot exhibited by the output voltage V13.

Figure 11A:
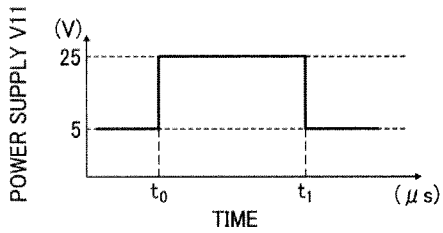
FIGS. 11A through 11C are graphs showing voltages in volts (V) plotted against time in microseconds (μs), obtained at a power supply terminal, an input terminal, and an output terminal, respectively, during operation of the semiconductor circuit of FIG. 10.
Figure 11B:
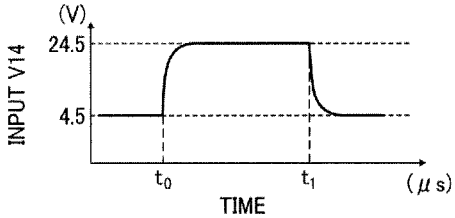
Figure 11C:
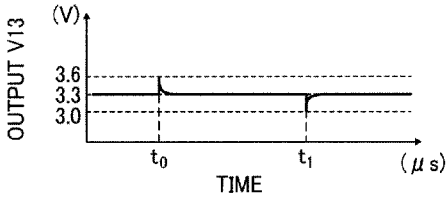

FIGS. 11A through 11C are graphs showing the voltages V11, V14, and V13 in volts (V) plotted against time in microseconds (μs), obtained at the power supply terminal 11, the input terminal 14, and the output terminal 13, respectively, during operation of the semiconductor circuit 20D.

As shown in FIGS. 11A through 11C, as the power supply voltage V11 suddenly increases from 5 V to 25 V at time to, the input voltage V14 of the voltage regulator 1 in turn increases from 4.5 V to 24.5 V, causing the output voltage V13 to transiently increase from 3.3 V to 3.6 V.

Note that the input voltage V14, whose amplitude is generally consistent with that of the power supply voltage V11, does not experience an abrupt, steep transition as that experienced by the power supply voltage V11 at time t0. Instead, the input voltage V14 gradually increases over a period of time after time t0. The transition of the input voltage, thus buffered or slowed down, results in an reduced amount of "overshoot" exhibited by the output voltage V13 rising above the constant level of 3.3 V, which is significantly smaller than that would otherwise be obtained.

Such overshoot suppression capability of the semiconductor circuit 20 upon a sudden increase in the power supply voltage V11 is derived from provision of the additional resistor R21 and capacitor C21, which forms a series RC circuit whose time constant limits the rate at which the gate voltage of the buffer transistor M21 increases, so as to effectively prevent an abrupt transition of the input voltage V14 due to a sudden increase in the power supply voltage V11, resulting in a small amount of overshoot exhibited by the output voltage V13.

Figure 12:
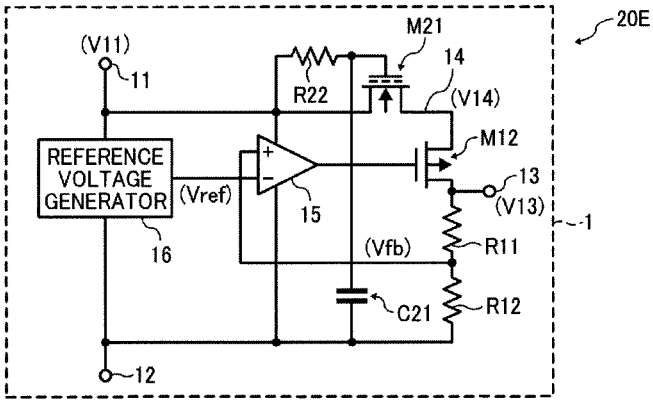
FIG. 12 is a circuit diagram schematically illustrating a semiconductor circuit according to a sixth embodiment of this patent specification.

FIG. 12 is a circuit diagram schematically illustrating a semiconductor circuit 20E according to a sixth embodiment of this patent specification.

As shown in FIG. 12, the overall configuration of the sixth embodiment is similar to that depicted in FIG. 6, except that the circuit 20E further includes a resistor R22 disposed between the power supply terminal 11 and the gate terminal of the buffer transistor M21, and a capacitor C21 disposed between the ground and the gate terminal of the buffer transistor M21.

In such a configuration, the semiconductor circuit 20E operates in a manner similar to that depicted primarily with reference to FIG. 6, wherein the depletion-mode transistor M21 provided between the power supply terminal 11 and the input terminal 14 serves as a constant current circuit conducting a drain current from the input terminal 14 to the power supply terminal 11 to discharge capacitance at the node 14 where the power supply voltage V11 suddenly falls below the input voltage V14, so as to prevent an abrupt transition of the input voltage V14 due to a sudden decrease in the power supply voltage V11, resulting in a small amount of undershoot exhibited by the output voltage V13.

Further, in the sixth embodiment, provision of the additional resistor R21 and capacitor C21, which forms a series RC circuit whose time constant limits the rate at which the gate voltage of the buffer transistor M21 increases, effectively prevents an abrupt transition of the input voltage V14 due to a sudden increase in the power supply voltage V11, resulting in a small amount of overshoot exhibited by the output voltage V13.

Figure 13:
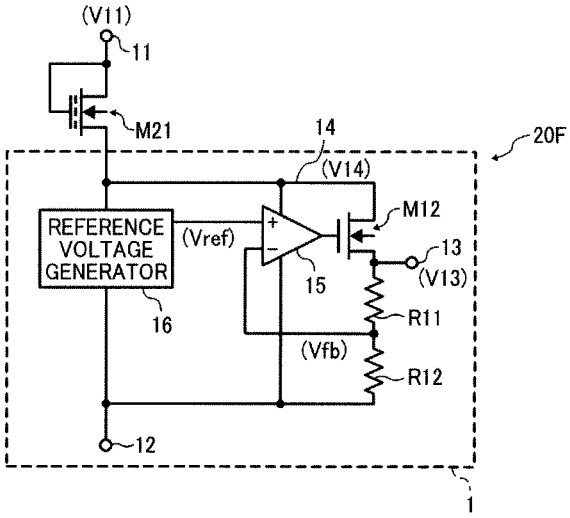
FIG. 13 is a circuit diagram schematically illustrating a semiconductor circuit according to a seventh embodiment of this patent specification.

FIG. 13 is a circuit diagram schematically illustrating a semiconductor circuit 20F according to a seventh embodiment of this patent specification.

As shown in FIG. 13, the overall configuration of the seventh embodiment is similar to that depicted in FIG. 3, except that the circuit 20F employs an NMOS transistor, instead of a PMOS transistor, as a driver transistor M12 of the voltage regulator 1.

In such a configuration, the semiconductor circuit 20F operates in a manner similar to that depicted primarily with reference to FIG. 3, wherein the depletion-mode transistor M21 provided between the power supply terminal 11 and the input terminal 14 serves as a constant current circuit conducting a drain current from the input terminal 14 to the power supply terminal 11 to discharge capacitance at the node 14 where the power supply voltage V11 suddenly falls below the input voltage V14, so as to prevent an abrupt transition of the input voltage V14 due to a sudden decrease in the power supply voltage V11, resulting in a small amount of undershoot exhibited by the output voltage V13.

In the seventh embodiment 20F, configuring the driver transistor M13 as an NMOS device allows for implementing the semiconductor circuit 20F in an IC that contains one or more circuit components integrated into a single integrated unit, which are in most cases designed to operate with a voltage regulated through a voltage regulator employing an NMOS driver transistor.

Thus, the seventh embodiment 20F is applicable to IC implementation not only where the output of the voltage regulator 1 is supplied to a load circuit outside of the IC, but also where the output of the voltage regulator 1 is supplied to a load circuit inside of the IC. The semiconductor circuit 20F is particularly effective as a voltage regulator to drive internal circuitry of an IC, where providing a capacitor inside the same IC for preventing variations in the output voltage is difficult due to space limitations or other design constraints.

Figure 14:
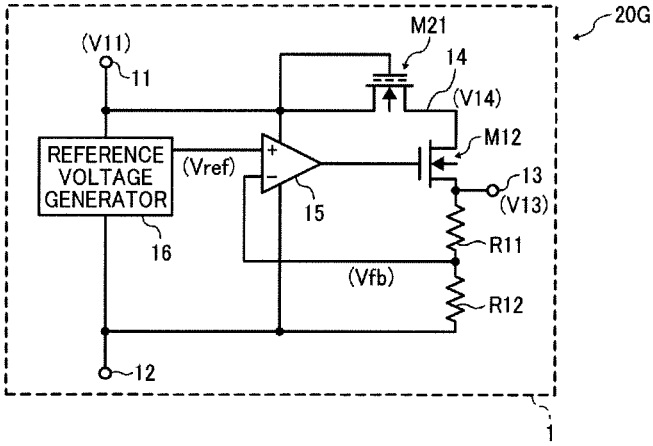
FIG. 14 is a circuit diagram schematically illustrating a semiconductor circuit according to an eighth embodiment of this patent specification.

FIG. 14 is a circuit diagram schematically illustrating a semiconductor circuit 20G according to an eighth embodiment of this patent specification.

As shown in FIG. 13, the overall configuration of the eighth embodiment is similar to that depicted in FIG. 6, except that the circuit 20G employs an NMOS transistor, instead of a PMOS transistor, as a driver transistor M12 of the voltage regulator 1.

In such a configuration, the semiconductor circuit 20G operates in a manner similar to that depicted primarily with reference to FIG. 6, wherein the depletion-mode transistor M21 provided between the power supply terminal 11 and the input terminal 14 serves as a constant current circuit conducting a drain current from the input terminal 14 to the power supply terminal 11 to discharge capacitance at the node 14 where the power supply voltage V11 suddenly falls below the input voltage V14, so as to prevent an abrupt transition of the input voltage V14 due to a sudden decrease in the power supply voltage V11, resulting in a small amount of undershoot exhibited by the output voltage V13.

As is the case with the seventh embodiment, in the seventh embodiment 20G, configuring the driver transistor M13 as an NMOS device allows for implementing the semiconductor circuit 20F in an IC that contains one or more circuit components integrated into a single integrated unit, which are in most cases designed to operate with a voltage regulated through a voltage regulator employing an NMOS driver transistor.

Thus, the eighth embodiment 20G is applicable to IC implementation not only where the output of the voltage regulator 1 is supplied to a load circuit outside of the IC, but also where the output of the voltage regulator 1 is supplied to a load circuit inside of the IC. The semiconductor circuit 20G is particularly effective as a voltage regulator to drive internal circuitry of an IC, where providing a capacitor inside the same IC for preventing variations in the output voltage is difficult due to space limitations or other design constraints.

To recapitulate, the semiconductor circuit 20 according to this patent specification includes a voltage regulator 1 to convert an input voltage V14 input to an input terminal 14 thereof from a power supply terminal 11 into an output voltage V13 output to an output terminal 13 thereof; and a buffer transistor M21, being an n-channel depletion-mode metal-oxide semiconductor field effect transistor, disposed between the power supply terminal 11 and the voltage regulator 1, with a gate terminal thereof connected to the power supply terminal 11, a drain terminal thereof connected to the power supply terminal 11, and a source terminal thereof connected to the input terminal 14 of the voltage regulator 1.

The semiconductor circuit 20 is protected against a significant undershoot of the output voltage V13 due to a sudden decrease in the power supply voltage V11, owing to the buffer transistor M21 serving as a constant current circuit conducting current from its source, input terminal 14 to its drain, power supply terminal 11 where the power supply voltage V11 falls below the input voltage V14, which can buffer or slow down the transition of the input voltage V14, resulting in a small amount of undershoot exhibited by the output voltage V13.

Providing the undershoot suppression capability through the single depletion-mode transistor M21 connected to the voltage regulator 1 does not require a large amount of power consumed by the buffering circuitry, while allowing for a fast response time to a change in the power supply input, compared to those provided by a known feedback circuit.

In further embodiment, the source terminal of the buffer transistor M21 may be connected solely to a conductive terminal of a driver transistor M12 connected between the input and output terminals of the voltage regulator 1. Such arrangement saves power consumed in the voltage regulator 1, which is particularly suitable for applications where the semiconductor circuit is operated at relatively low input voltages.

In still further embodiment, the semiconductor circuit 20 may include a resistor R21 disposed between the power supply terminal 11 and the drain terminal of the buffer transistor M21. Such arrangement allows the semiconductor circuit 20 to more effectively prevent an abrupt transition in the input voltage V14 due to a sudden decrease in the power supply voltage V11 without requiring additional power consumption.

In yet still further embodiment, the semiconductor circuit 20 may include a resistor R22 disposed between the power supply terminal 11 and the gate terminal of the buffer transistor M21, and a capacitor C21 disposed between a ground and the gate terminal of the buffer transistor M21. Such arrangement provides the semiconductor circuit 20 with an overshoot suppression capability, in addition to the undershoot suppression capability, without requiring additional power consumption, in which the additional resistor and capacitor R22 and C21 form a series RC circuit whose time constant limits the rate at which the gate voltage of the buffer transistor M21 increases, so as to effectively prevent an abrupt transition of the input voltage V14 due to a sudden increase in the power supply voltage V11, resulting in a small amount of overshoot exhibited by the output voltage V13.

Hence, the semiconductor circuit according to this patent specification is provided with undershoot/overshoot suppression capabilities that can operate with relatively low operating current, which protects the voltage regulator against significant undershoot/overshoot of the output voltage where the power supply voltage suddenly changes. Such semiconductor circuit may find application in high-voltage regulator or any suitable electronic device incorporating voltage regulation circuitry.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application No. 2010-160572 filed on Jul. 15, 2010 in the Japanese Patent Office, the entire contents of which are hereby incorporated by reference herein.

What is claimed is:

1. A semiconductor circuit for use in connection with a power supply terminal, the circuit comprising:
- a voltage regulator to convert an input voltage input to an input terminal thereof into an output voltage output to an output terminal thereof; and
- a buffer transistor, being an n-channel depletion-mode metal-oxide semiconductor field effect transistor, disposed between the power supply terminal and the voltage regulator with a gate terminal thereof connected to the power supply terminal, a drain terminal thereof connected to the power supply terminal, and a source terminal thereof connected to the input terminal of the voltage regulator, a voltage at the gate terminal being higher than a voltage at the source terminal.

2. The semiconductor circuit according to claim 1, further comprising a resistor disposed between the power supply terminal and the drain terminal of the buffer transistor.

3. The semiconductor circuit according to claim 1, further comprising:
- a resistor disposed between the power supply terminal and the gate terminal of the buffer transistor; and
- a capacitor disposed between a ground and the gate terminal of the buffer transistor.

4. The semiconductor circuit according to claim 1, wherein the voltage regulator is implemented in an integrated circuit containing one or more circuit components integrated into a single integrated unit, at least one of the circuit components supplied with the output voltage regulated through the voltage regulator.

5. The semiconductor circuit according to claim 1, wherein the voltage regulator includes a driver transistor connected between the input and output terminals thereof, the source terminal of the buffer transistor being connected solely to a conductive terminal of the driver transistor.

6. The semiconductor circuit according to claim 5, further comprising a resistor disposed between the power supply terminal and the drain terminal of the buffer transistor.

7. The semiconductor circuit according to claim 5, further comprising:
- a resistor disposed between the power supply terminal and the gate terminal of the buffer transistor; and
- a capacitor disposed between a ground and the gate terminal of the buffer transistor.

8. The semiconductor circuit according to claim 5, wherein the voltage regulator is implemented in an integrated circuit containing one or more circuit components integrated into a single integrated unit, at least one of the circuit components being supplied with the output voltage regulated through the voltage regulator.

9. The semiconductor circuit according to claim 8, wherein the driver transistor of the voltage regulator is an n-channel field effect transistor.

10. A voltage regulator for use in connection with a power supply terminal, the voltage regulator comprising:
- an input terminal to receive an input voltage supplied from the power supply terminal;
- an output terminal to output an output voltage to load circuitry;
- a driver transistor connected between the input and output terminals to convert the input voltage into the output voltage; and
- a buffer transistor, being an n-channel depletion-mode metal-oxide semiconductor field effect transistor, disposed between the power supply terminal and the voltage regulator with a gate terminal thereof connected to the power supply terminal, a drain terminal thereof connected to the power supply terminal, and a source terminal thereof connected to the input terminal of the voltage regulator, a voltage at the gate terminal being higher than a voltage at the source terminal.

11. The voltage regulator according to claim 10, wherein the source terminal of the buffer transistor is connected solely to a conductive terminal of the driver transistor.

12. The semiconductor circuit according to claim 1, wherein the voltage at the gate terminal of the buffer transistor is equal to a voltage at the drain terminal of the buffer transistor.

13. The semiconductor circuit according to claim 1, wherein the voltage regulator includes a differential amplifier having a positive power supply input terminal connected to the drain terminal of the buffer transistor.

14. The semiconductor circuit according to claim 1, wherein the voltage regulator includes a reference voltage generator having an input terminal thereof connected to the drain terminal of the buffer transistor.

15. The semiconductor circuit according to claim 1, wherein the voltage regulator comprises:
- a reference voltage generator outputting a reference voltage and having an input terminal thereof connected to the drain terminal of the buffer transistor; and
- a differential amplifier having a positive power supply input terminal connected to the drain terminal of the buffer transistor, wherein the reference voltage output by the reference voltage generator s supplied to an inverting terminal of the differential amplifier.

* * * * *